US006613228B2

(12) United States Patent
Petersen et al.

(10) Patent No.: US 6,613,228 B2
(45) Date of Patent: Sep. 2, 2003

(54) MANHOLE DEBRIS-CATCHING SYSTEM

(76) Inventors: John G. Petersen, 1943 W. Marshall Ave., Phoenix, AZ (US) 85015; William C. Holmes, 4002 E. Fairmount Ave., Phoenix, AZ (US) 85018

( * ) Notice: Subject to any disclaimer, the term of this patent is extended or adjusted under 35 U.S.C. 154(b) by 167 days.

(21) Appl. No.: 09/921,768

(22) Filed: Aug. 3, 2001

(65) Prior Publication Data

US 2002/0023864 A1 Feb. 28, 2002

Related U.S. Application Data

(60) Provisional application No. 60/228,355, filed on Aug. 28, 2000.

(51) Int. Cl.[7] ..... E02D 29/12; E02D 29/14

(52) U.S. Cl. ..... 210/541; 52/20; 52/21; 52/124.2; 405/36; 264/152; 264/156

(58) Field of Search ..... 210/541; 52/20, 52/21, 124.2; 405/36; 264/152, 156

(56) References Cited

U.S. PATENT DOCUMENTS 3,621,623 A * 11/1971 Downes
4,030,851 A * 6/1977 Graybeal
4,305,679 A * 12/1981 Modi
4,957,389 A * 9/1990 Neathery
5,382,113 A * 1/1995 Chilton et al.
5,540,411 A * 7/1996 Strickland
5,752,787 A * 5/1998 Trangsrud
6,226,928 B1 * 5/2001 Trangsrud

* cited by examiner

*Primary Examiner*—Thomas M. Lithgow
(74) *Attorney, Agent, or Firm*—Martin L. Stoneman

(57) ABSTRACT

A debris-catching system for preventing debris from falling into the pipe opening at the bottom of a manhole catch basin. The debris-catcher comprises two semi-circular halves hinged together such that the two halves may be folded and inserted into a manhole opening. The debris-catcher comprises aligned apertures that allow it to be hooked and lowered into a manhole. The two halves are opened up to form a circular blocker which sets on the manhole bottom flat base. The debris-catcher allows normal effluent flow through the manhole while in place. The debris-catcher floats and will do so during an overflow condition. Further, the debris-catcher will resume its protective function after an overflow condition has subsided.

27 Claims, 4 Drawing Sheets

MANHOLE DEBRIS-CATCHING SYSTEM

CROSS-REFERENCE TO RELATED APPLICATION

The present application is related to applicant's prior provisional application Ser. No. 60/228,355, filed Aug. 28, 2000, entitled "DYNAMIC DEBRIS SHIELD", the contents of which are hereby herein incorporated by reference.

BACKGROUND

This invention relates to providing a debris-catching system for preventing debris from falling or being thrown, etc., into the pipe opening (sometimes herein called "pipe trench") at the bottom of a manhole catch basin.

Typically, manholes are placed for the purpose of servicing storm or sewer systems. Such manholes typically consist of a bottom catch-basin constructed of brick, pre-cast concrete or poured-on-site concrete set at the level of the fluid transferring pipe. One end of at least one pipe typically is set into the manhole such that the effluent flows into one or more trenches in the manhole bottom and flows through the manhole into one or more pipes entering other portions of the manhole. Such other pipes are generally within the same vertical elevation, but sometimes may be at slightly varied elevations. Such pipe may be only a few feet below ground, to many feet below ground, in a general range of about four to twenty feet. Catch basins are usually provided in preselected diameters. Typically, pre-cast sections of the manhole may be added to the lower portion to adjust the manhole in height to account for the depth required to reach the surface height. The manhole typically comprises a ladder (made up of ladder rungs spaced apart) within it in which a person may use to descend to the manhole bottom. The manhole is typically removably sealed by a cover, which is usually flush with the surface. The surface usually consists of landscape, an alleyway, parking area or roadway, as the storm and sewer lines are generally placed within an easement in such an area.

In new construction, the manhole is placed and the piping is attached to the manhole. However, because the surface is usually the last area to be finished, the manhole is only temporarily covered. Such covers are usually made of metal and cover only the top of the manhole. Debris often enters the manhole as vehicles and other construction activity occurs. Such debris may easily amount to hundreds of pounds of dirt, asphalt or rain-washed debris from the construction site. The piping may or may not be in use during this construction activity. If the piping is new and not in use, it is usually inspected prior to being buried. After such inspection, it is a costly endeavor to expose the pipe, or have it vacuumed out if it becomes blocked due to debris. If the piping is in use, an expensive and messy blockage may occur.

A need exists to adequately protect such piping in a manhole from debris blockage while still permitting the piping to be utilized.

OBJECTS OF THE INVENTION

A primary object and feature of the present invention is to provide a system for blocking debris from entering the piping system of a manhole.

It is a further object and feature of the present invention to provide such a system which assists in preventing debris from entering the piping system within the manhole.

It is a further object and feature of the present invention to provide such a system which is easily installed and removed.

It is a further object and feature of the present invention to provide such a system which provides for the continued system operation in the event the manhole is flooded.

A further primary object and feature of the present invention is to provide such a system which is efficient, inexpensive, and handy. Other objects and features of this invention will become apparent with reference to the following descriptions.

SUMMARY OF THE INVENTION

In accordance with a preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: substantially-rigid blocker means, supportable by the flat bottom portions and larger than the round top, for blocking debris from entering the pipe trench portions; and fold means for folding such blocker means so as to permit entry of such blocker means, when folded, into the manhole catch basin through the round top.

Additionally, it provides such a system wherein such blocker means comprises attachment means for attaching at least one lifting device to such blocker means. It also provides such a system wherein such attachment means comprises at least one aperture; and it provides such a system wherein such blocker means is floatable. Further, it provides such a system wherein such fold means comprises at least one hinge. And, it provides such a system wherein such blocker means, when not folded and when supported by the flat bottom portions, is capable of substantially covering the pipe trench portions. Moreover, it provides such a system wherein such blocker means, when not folded and when supported by the flat bottom portions, is capable of substantially covering the pipe trench portions. It provides such a system wherein such blocker means, when not folded and when supported by the flat bottom portions, is capable of supporting at least about one-hundred pounds.

In accordance with another preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: substantially-rigid blocker, supportable by the flat bottom portions and larger than the round top, structured and arranged, when not folded and when supported by the flat bottom portions, to block debris from entering the pipe trench portions; and at least one hinge structured and arranged to permit folding of such blocker so as to permit entry of such blocker, when folded, through the round top.

It also provides such a system wherein such blocker is substantially round. And, it provides such a system wherein such blocker comprises at least one hinge connection having at least one hinge axis through a center of such blocker. It even provides such a system wherein such blocker is floatable. Further, it provides such a system wherein such at least one hinge connection comprises three corrosion-resistant strap hinges. And, it provides such a system wherein such at least one hinge connection comprises: three stainless steel strap hinges; and a plurality of stainless steel bolts, corrosion resistant washers, and stainless steel nuts; wherein such plurality of stainless steel bolts, corrosion resistant washers and stainless steel nuts connects such three stainless steel strap hinges with such blocker.

Even further, it provides such a system wherein such blocker comprises at least one attachment structured and arranged to permit removable attaching of at least one lifting device to such blocker. It also provides such a system wherein such attachment comprises at least one aperture. Still further, it provides such a system wherein such blocker, when not folded and when supported by the flat bottom portions, substantially covers the pipe trench portions. And, it provides such a system wherein such blocker is capable of supporting at least one-hundred pounds of debris. Still further, it provides such a system wherein such blocker is capable of supporting at least one normal-sized worker.

In accordance with yet another preferred embodiment hereof, this invention provides a debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination: a substantially round blocker, wherein such blocker comprises, a substantially-rigid structural material, two half-portions, at least one hinge connection connecting such two half-portions; wherein such blocker may be placed in a substantially folded position and in an open substantially-flat position, wherein each such half-portion comprises an aperture, each such aperture being structured and arranged to align with each other such aperture when such blocker is placed in such substantially folded position, whereby such apertures may be used as attachments in lifting and lowering such blocker when such blocker is in such substantially folded position; wherein such substantially round blocker, when in such open substantially-flat position, is structured and arranged to be able to substantially cover the pipe trench portions.

Additionally, it provides such a system wherein such substantially round blocker has a diameter selected from the group consisting of: diameters of about forty-four inches to about forty-eight inches; diameters of about fifty-four inches to about sixty inches. And, it provides such a system wherein such structural material comprises High Density Polyethylene (HDPE). Further, it provides such a system wherein such at least one hinge connection comprises: three corrosion-resistant strap hinges; and a plurality of corrosion-resistant bolts, corrosion-resistant washers, and corrosion-resistant nuts; wherein such plurality of corrosion-resistant bolts, corrosion-resistant washers and corrosion-resistant nuts connects such corrosion-resistant strap hinges to such substantially round blocker.

In accordance with a preferred embodiment hereof, this invention also provides a method of making a debris-catcher, for impeding debris from entering pipe trench portions of a manhole catch basin, having a round top with a first diameter, flat bottom portions extending over a first area having a second diameter larger than the first diameter, and pipe trench portions below the flat bottom portions, comprising the steps of: providing a structural material having an area capable of being cut to a diameter of the required end size; cutting such structural material into two equal halves; cutting each such half in a semi-circle shape having a radius half that of such desired end diameter of such debris-catcher so that each such respective half is substantially equal to each other such half; drilling a lifting aperture in each such half wherein: each such lifting aperture is structured and arranged to align with each other respective such lifting aperture when each respective such half is aligned; and whereby each respective aligned lifting aperture can be used together to lift such halves when aligned; drilling a plurality of hinge-installation apertures in each such half in such manner as to enable insertion of a corrosion-resistant bolt through each respective such hinge-installation aperture; attaching at least one hinge to each such half using such corrosion-resistant bolts, at least one washer, and at least one corrosion-resistant nut, along a hinge axis corresponding to a flat edge of each such half so that such halves can be folded together in a folded position for entry through the top and opened to a substantially-flat position to provided a round such debris catcher having such desired diameter of such required end size.

It also provides such a system wherein such structural material comprises High Density Polyethylene (HDPE). And, it provides such a system wherein such at least one hinge comprises three corrosion-resistant strap hinges.

In accordance with another preferred embodiment hereof, this invention also provides a method of using a debris-catcher for impeding debris from entering pipe trench portions of a manhole catch basin, having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises an aperture, each such aperture being structured and arranged to align with each other such aperture when such blocker is placed in such substantially folded position, comprising the steps of: selecting a debris-catcher having such desired diameter of such required end size structured and arranged to substantially cover the pipe trench portions below the flat bottom portions when opened to a substantially-flat position; folding the debris-catcher in a folded position along a hinge axis corresponding to a flat edge of each such half so that such halves can be folded together in a folded position for entry through the round top of the manhole; attaching a lifting device through each aligned aperture and lifting and lowering the debris-catcher through the top of the manhole and down through the manhole catch basin to the flat bottom portions; un-attaching the lifting device from the debris-catcher; unfolding the debris-catcher such that the debris-catcher is opened to a substantially-flat position with the hinges facing upward toward the top of the manhole; aligning the hinge axis such that most of the hinge axis is supported by the flat bottom portions.

DETAILED DESCRIPTION OF A PREFERRED EMBODIMENT OF THE INVENTION

Figure 1:
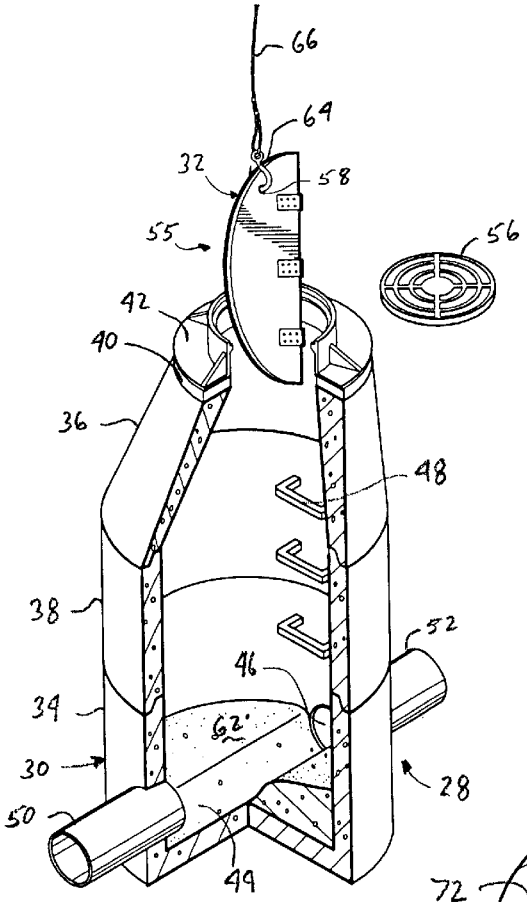
FIG. 1 is a perspective view, partially in section, of a typical manhole structure illustrating the debris-catching system and insertion of a debris-catcher, according to a preferred embodiment of the present invention.

Reference is now made to the drawings. FIG. 1 is a perspective view, partially in section, of a typical manhole structure 30 illustrating the debris-catching system 28 and insertion of a debris-catcher 32 (embodying herein substantially-rigid blocker means, supportable by the flat bottom portions and larger than the round top, for blocking debris from entering the pipe trench portions; and also embodying herein a substantially-rigid blocker, supportable by the flat bottom portions and larger than the round top, structured and arranged, when not folded and when supported by the flat bottom portions, to block debris from entering the pipe trench portions), according to a preferred embodiment of the present invention. A typical manhole structure 30 comprises a lower portion 34, a top portion 36, and may comprise one or more center portions 38. The center portions 38 assist in adjusting the manhole structure 30 to the approximate desired height. In addition, the top portion 36 may also comprise additional height adjusting rings 40 and a manhole cover mounting frame 42 to more closely adjust the height required to reach the surface 31 (shown best on FIG. 6). Preferably, the lower portion 34 comprises one or more depressions identified as trench 44. Preferably, trench 44 is in line with the inflow pipe 50 or outflow pipe 52 (no particular order is intended, as either pipe may be inflow or outflow; such inflow pipe 50 or such outflow pipe 52 may comprise more than one pipe) and allows access to the pipe interior 46 for maintenance purposes. Preferably, the manhole structure 30 also comprises a plurality of ladder rungs 48 for entry into the manhole structure 30. The manhole opening 54 is a standard size, preferably round in shape, as shown. Such manhole openings 54 are typically twenty-four inches in diameter, or thirty inches in diameter. Preferably, a cover 56 of the appropriate size sets in the manhole cover mounting frame 42 and covers the manhole opening 54.

Preferably, debris-catcher 32 comprises two apertures 58 and 60 (embodying herein wherein such blocker means comprises attachment means for attaching at least one lifting device to such blocker means; and embodying herein wherein such attachment means comprises at least one aperture; and also embodying herein wherein such blocker comprises at least one attachment structured and arranged to permit removable attaching of at least one lifting device to such blocker; and further embodying herein wherein such attachment comprises at least one aperture), which align when the debris-catcher 32 is folded, as shown (the above arrangement embodying herein wherein each such half-portion comprises an aperture, each such aperture being structured and arranged to align with each other such aperture when such blocker is placed in such substantially folded position). Preferably, an attacher, such as a hook 64, is attached through the aligned apertures 58 and 60. Preferably, in combination with a lowering mechanism, such as a rope 66 (this arrangement embodying herein at least one lifting device), the debris-catcher 32 may be lowered or raised through the manhole opening 54 (this arrangement embodying herein whereby such apertures may be used as attachments in lifting and lowering such blocker when such blocker is in such substantially folded position), while in a substantially folded position 55, to the flat base 62 portion of the lower portion 34. Under appropriate circumstances, other suitable arrangements may suffice. The debris-catcher 32 may be carried down the ladder rungs 48; however, due to the weight and size of the debris-catcher 32, such a method may be undesirable and is not preferred.

Figure 2:
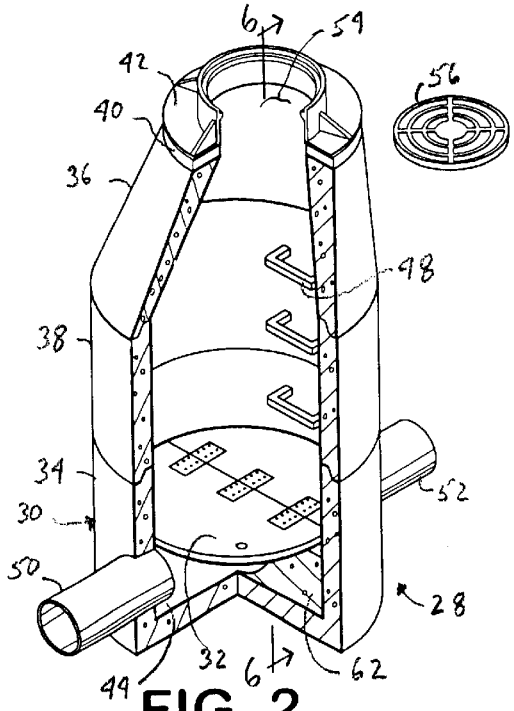
FIG. 2 is a perspective view, partially in section, of a typical manhole structure and an installed debris-catcher, according to a preferred embodiment of the present invention.

FIG. 2 is a perspective view, partially in section, of a typical manhole structure 30 and an installed debris-catcher 32, according to a preferred embodiment of the present invention. Preferably, the debris-catcher 32 is opened up and placed in a substantially open position 68 on the flat base 62 portion of the lower portion 34 of the manhole structure 30, as shown in FIG. 2. Preferably, the debris-catcher 32 rests directly on the flat base 62 and substantially covers trench 44 (the above described arrangement embodying herein wherein such blocker means, when not folded and when supported by the flat bottom portions, is capable of substantially covering the pipe trench). Typically, the flat base 62 is round, and either forty-eight inches in diameter, or sixty inches in diameter. Preferably, the debris-catcher 32 is also round (embodying herein wherein such blocker is substantially round), and at least forty-four inches in diameter for a forty-eight inch flat base 62, and at least fifty-six inches in diameter for a sixty inch flat base 62 (this arrangement embodying herein wherein such substantially round blocker has a diameter selected from the group consisting of: diameters of about forty-four inches to about forty-eight inches; diameters of about fifty-four inches to about sixty inches). Preferably, the debris-catcher 32 is slightly less than the full diameter of the flat base, as such manhole structures 30 are not usually a perfect diameter and may have a ladder rung 48 that will interfere with opening a folded debris-catcher 32 that is too large a diameter.

Figure 3:
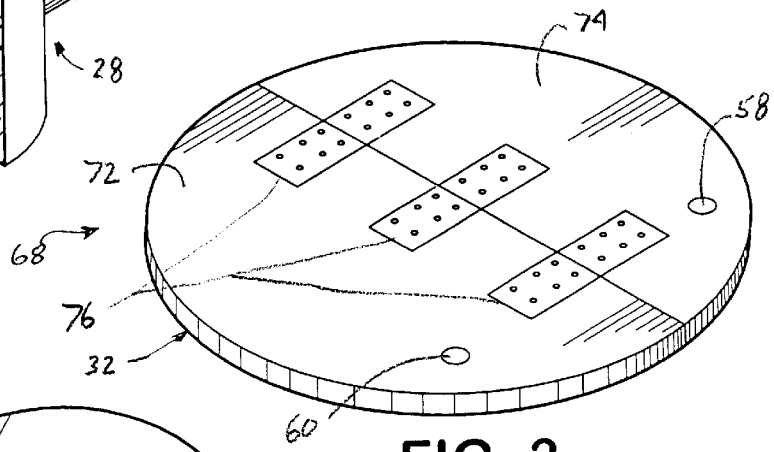
FIG. 3 is a perspective view of a debris-catcher in the open position, according to a preferred embodiment of the present invention.

FIG. 3 is a perspective view of a debris-catcher 32 in the open position 68, according to a preferred embodiment of the present invention.

Figure 4:
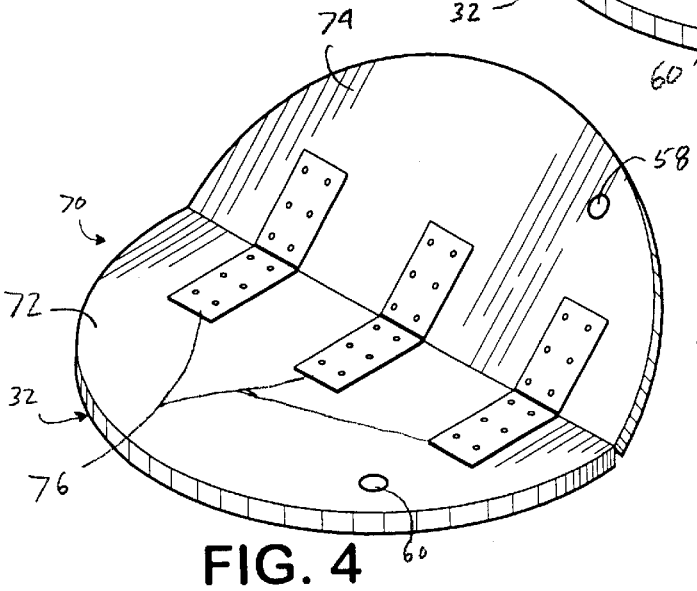
FIG. 4 is a perspective view of a debris-catcher in a partially folded position, according to a preferred embodiment of the present invention.

FIG. 4 is a perspective view of a debris-catcher 32 in a partially folded position 70, according to a preferred embodiment of the present invention. Preferably, the debris-catcher 32 comprises two halves 72 and 74 (embodying herein two half-portions). Preferably, each half 72 and 74 is substantially a semi-circle, as shown. Preferably, each half 72 and 74 is connected together by hinges 76 (embodying herein at least one hinge connection connecting such two half-portions; and also embodying herein wherein such fold means comprises at least one hinge; and, embodying herein wherein such blocker comprises at least one hinge connection having at least one hinge axis through a center of such blocker). Preferably, hinges 76 comprise three strap hinges, as shown. Preferably, the hinges 76 are type 304 stainless steel (the above arrangement embodying herein wherein such at least one hinge connection comprises three corrosion-resistant strap hinges; and, embodying herein three stainless steel strap hinges). Each hinge is preferably six-knuckle construction with one-half inch ends, three-quarter inch centers being pin spun on both ends. Preferably, the hinges 76 are about four inches wide and sixteen inches long (each half-hinge being eight inches long). Preferably, the hinges 76 are 0.0800–0.125 inches thick. Under appropriate circumstances, other connection arrangements and material specifications may be suitable.

Figure 14:
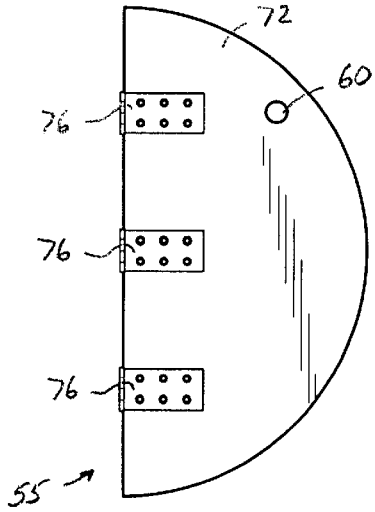
FIG. 14 is a top view of the debris-catcher in the folded position, according to a preferred embodiment of the present invention.
Figure 13:
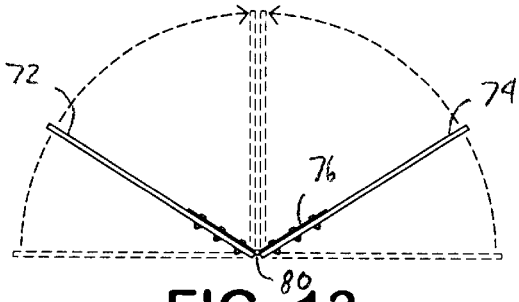
FIG. 13 is a side view of the debris-catcher in a partially folded position, illustrating the folding range of motion, according to a preferred embodiment of the present invention.

Preferably, the hinges 76 are attached to the debris-catcher 32 such that when the debris-catcher 32 is in the open position 68, the debris-catcher 32 lays in about a flat plane, as shown. Preferably, the hinges 76 are attached to the debris-catcher 32 such that when the debris-catcher 32 is in the folded position 55, the two halves 72 and 74 may be folded in a semi-circle (see FIG. 13 and FIG. 14) configuration allowing entry into the manhole opening 54, as illustrated in FIG. 1, (the above arrangement embodying herein wherein such blocker may be placed in a substantially folded position and in an open substantially-flat position; and, embodying herein fold means for folding such blocker means so as to permit entry of such blocker means, when folded, into the manhole catch basin through the round top; and, also embodying herein at least one hinge structured and arranged to permit folding of such blocker so as to permit entry of such blocker, when folded, through the round top).

Figure 5:
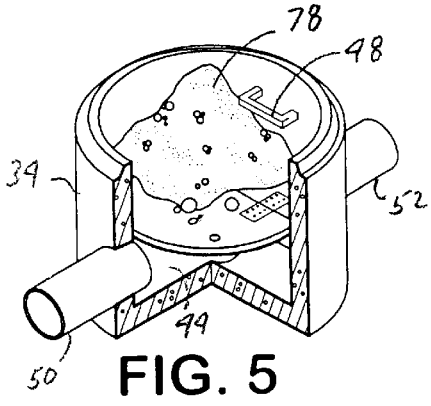
FIG. 5 is a perspective view, partially in section, of the lower section of a typical manhole structure illustrating the debris-catcher blocking debris, according to a preferred embodiment of the present invention.

FIG. 5 is a perspective view, partially in section, of the lower section 34 of a typical manhole structure 30 illustrating the debris-catcher 32 blocking debris 78, according to a preferred embodiment of the present invention. Preferably, the debris-catcher 32, in the open position 68, rests on the flat base 62, as shown, such that the debris-catcher 32 covers the trench 44 (this arrangement embodying herein wherein such substantially round blocker, when in such open substantially-flat position, is structured and arranged to be able to substantially cover the pipe trench portions). Under appropriate circumstances, other suitable arrangements may suffice. Preferably, as debris falls into the manhole structure 30, it lands on the debris-catcher 32. Preferably, the debris-catcher 32 maintains its integrity and holds the debris 80 until such time as the debris 80 is removed. The present method and composition described herein provides for the debris-catcher 32 to hold well over a hundred pounds of debris 80 (embodying herein wherein such blocker is capable of supporting at least one-hundred pounds of debris; and embodying herein wherein such blocker means, when not folded and when supported by the flat bottom portions, is capable of supporting at least about one-hundred pounds). Preferably, the debris-catcher 32 will hold the weight of a normal-sized person in addition to the weight of the debris 80 (embodying herein wherein such blocker is capable of supporting at least one normal-sized worker), as a person normally will descend the manhole structure 30 to remove the debris 80. This total weight may be as much as about four hundred pounds using the described preferred embodiments.

Figure 6:
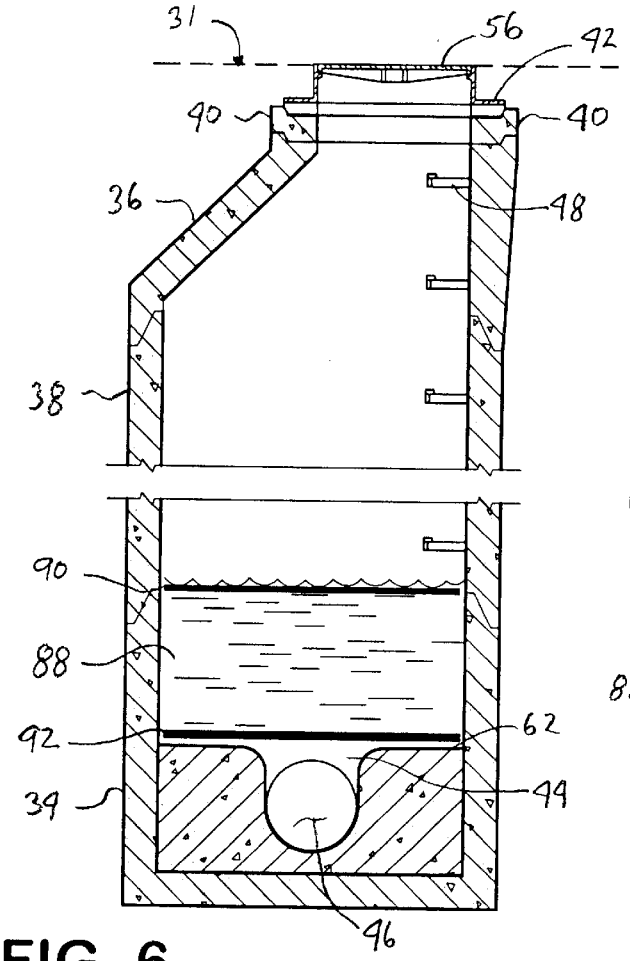
FIG. 6 is a sectional view through the section 6—6 of FIG. 2.

FIG. 6 is a sectional view through section 6—6 of FIG. 2. In one preferred embodiment, the debris-catcher 32 is preferably made from a substantially rigid material (embodying herein a substantially-rigid structural material). The preferred material is High Density Polyethylene, referred to herein as HDPE (embodying herein wherein such structural material comprises High Density Polyethylene). HDPE has excellent chemical resistant properties, weathering capabilities, and stress absorption properties, which make it an excellent choice for use as a debris-catcher 32. Further, HDPE floats. The preferred thickness is one-half inch HDPE sheeting. Preferably, when the debris-catcher 32 is made from HDPE and installed in the manhole structure 30, the debris-catcher 32 allows the uninterrupted function of the flow of effluent or matter through the manhole structure 30. In addition, the debris-catcher 32 will float, as indicated by line 90 in FIG. 6, should an overflow 88 occur (this is what is meant by "floatable", including buoyancy and lifting by overflow pressure) and will resume its position, as indicated by line 92, on the flat base 62 when the overflow 88 has subsided (this arrangement embodying herein wherein such blocker means and blocker is floatable). Preferably, the hinge axis (joint 80) of the debris-catcher 32 is located perpendicular to the trench 44. However, in situations where more than one trench 44 is used, the joint is preferably located such that it is not in-line with the trench 44. Examples of other trench arrangements are illustrated in FIG. 7, FIG. 8 and FIG. 9.

Figure 7:
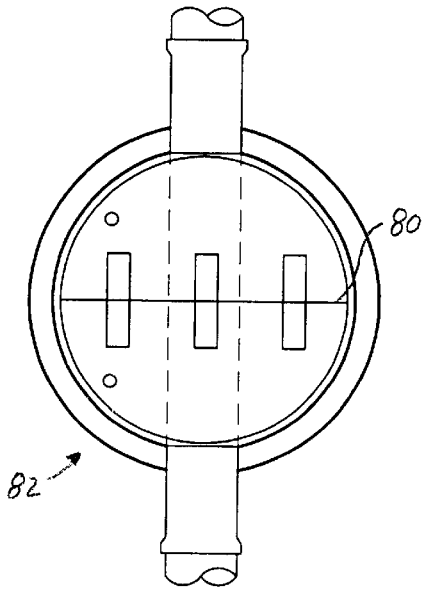
FIG. 7 is a top view, partially in section, illustrating the preferred joint placement of the debris-catcher in a single pipeline manhole installation, according to a preferred embodiment of the present invention.

FIG. 7 is a top view, partially in section, illustrating the preferred joint 80 placement of the debris-catcher 32 in a single pipeline manhole 82 installation application, according to a preferred embodiment of the present invention.

Figure 8:
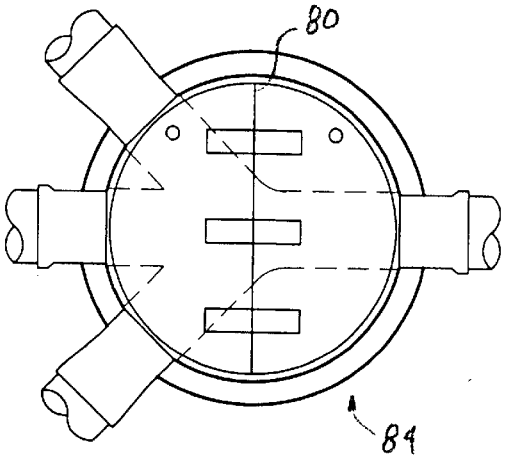
FIG. 8 is a top view, partially in section, illustrating the preferred joint placement of the debris-catcher in a three-way Y-pipeline manhole installation, according to a preferred embodiment of the present invention.

FIG. 8 is a top view, partially in section, illustrating the preferred joint 80 placement of the debris-catcher 32 in a three-way Y-pipeline manhole 84 installation application, according to a preferred embodiment of the present invention.

Figure 9:
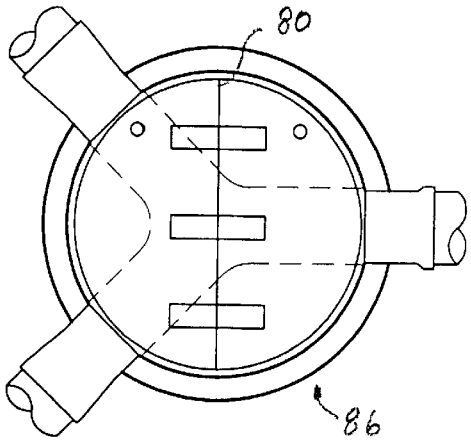
FIG. 9 is a top view, partially in section, illustrating the preferred joint placement of the debris-catcher in a two-way Y-pipeline manhole installation, according to a preferred embodiment of the present invention.
Figure 10:
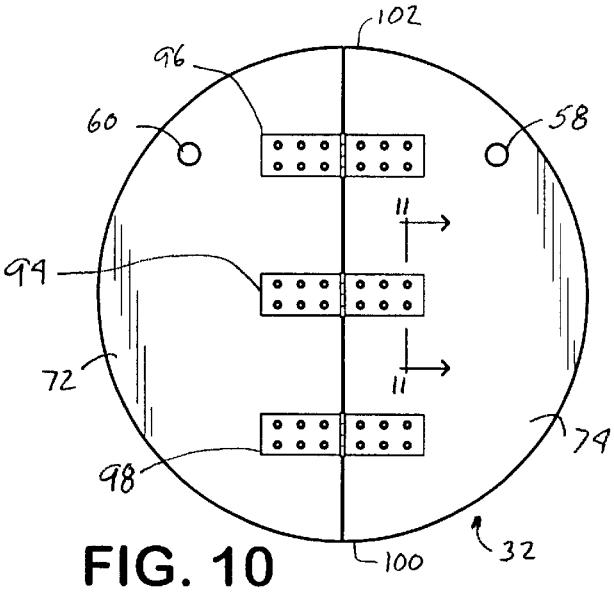
FIG. 10 is a top view of a debris-catcher, according to a preferred embodiment of the present invention.

FIG. 9 is a top view, partially in section, illustrating the preferred joint 80 placement of the debris-catcher 32 in a two-way Y-pipeline 86 manhole installation application, according to a preferred embodiment of the present invention. FIG. 10 is a top view of a debris-catcher 32, according to a preferred embodiment of the present invention. Preferably, as illustrated in FIG. 10, the hinges 76 comprise three hinges 94, 96 and 98. Preferably, hinge 94 is attached to the debris-catcher 32 such that it is located transverse to the joint 80, approximately midway between the two ends 100 and 102, as shown. Preferably, hinge 96 is located transverse to joint 80, approximately midway between hinge 94 and the end 102, as shown. Preferably, hinge 98 is located transverse to joint 80 approximately midway between hinge 94 and the end 100, as shown. Under appropriate circumstances, other arrangements may suffice.

Figure 11:
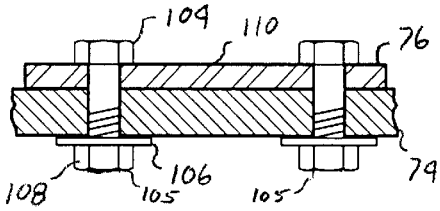
FIG. 11 is a sectional view through the section 11—11 of FIG. 10.

FIG. 11 is a sectional view through section 11—11 of FIG. 10.

Figure 12:
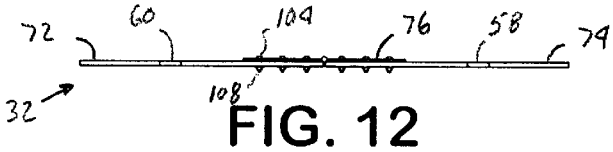
FIG. 12 is a side view of the debris-catcher, according to a preferred embodiment of the present invention.

FIG. 12 is a side view of the debris-catcher 32, according to a preferred embodiment of the present invention. Preferably, as illustrated in FIG. 11 and more specifically shown in FIG. 18, the hinges 76 are attached to each half 72 and 74 using a bolt 104, washer 106, and nut 108 arrangement. Preferably, each hinge 76 is attached using a plurality of corrosion-resistant bolts 104, washers 106, and nuts 108 (embodying herein a plurality of stainless steel bolts, corrosion resistant washers, and stainless steel nuts; and also embodying herein wherein such plurality of stainless steel bolts, corrosion resistant washers and stainless steel nuts connects such three stainless steel strap hinges with such blocker). In the illustrated embodiment of FIG. 18, twelve such bolt 104, washer 106 and nut 108 arrangements are preferably utilized. Preferably, bolt 104 is placed through the top 110 of hinges 76 through pre-drilled holes 112 (see FIG. 18), passing through matching aligned pre-drilled holes 114 in the debris-catcher 32, as shown. Preferably, washer 106 is placed onto bolt 104, followed by nut 108, which is then preferably threaded onto bolt 104, in well-known ways, such that the nut 108 is tight against the washer 106 and debris-catcher 32. In addition, the bolt 104 is preferably about flush with the bottom 105 of the nut 108 when the nut 108 has been fully tightened. Preferably, in the above described manner, the hinges 76 are firmly attached to the debris-catcher 32.

Preferably, bolts 104 are military standard MS35307 hexagon head, steel, corrosion resisting bolts. In the preferred embodiment using one-half inch HDPE and 0.0800–0.125 inch thick hinges, a one-inch long bolt 104 is preferred. Preferably, bolt 104 has a diameter of three-eights of an inch. Under appropriate circumstances, other arrangements may suffice. Preferably, washers 106 are military standard MS15795 flat-metal round washers sized to fit bolts 104. Preferably, nuts 108 are military standard MS51971 steel, hexagon, corrosion resisting bolts sized to fit bolts 104.

Figure 15:
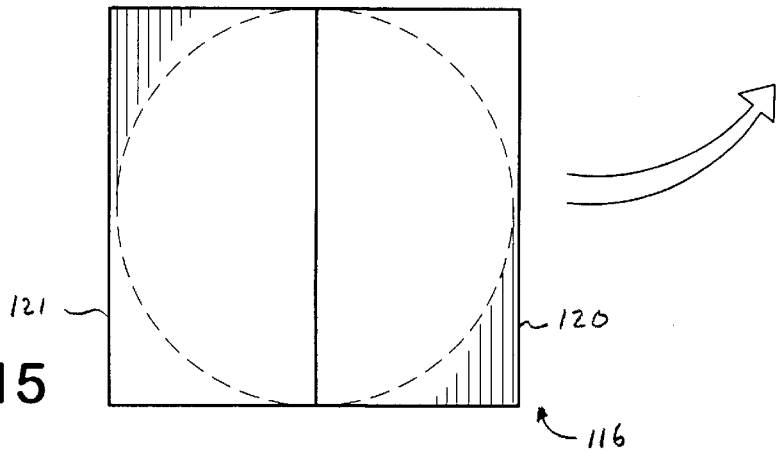
FIG. 15 is a diagrammatic top view of the first step in a method of making a debris-catcher, according to a preferred embodiment of the present invention.
Figure 16:
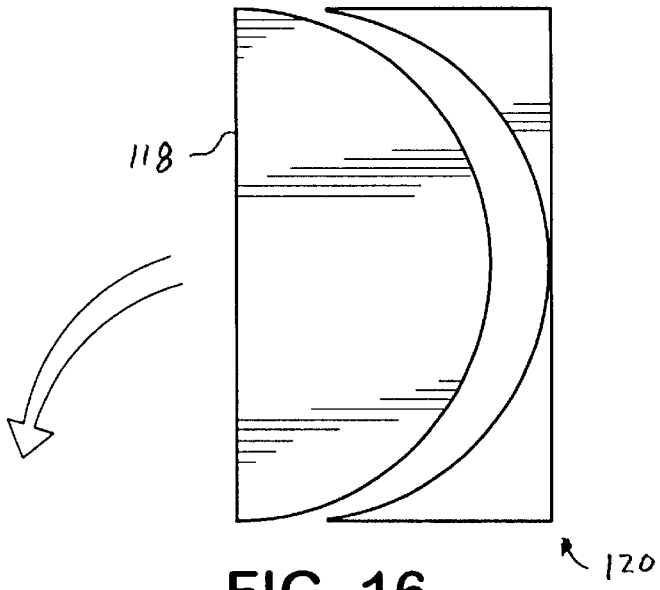
FIG. 16 is a diagrammatic top view of another step in a method of making a debris-catcher, according to a preferred embodiment of the present invention.
Figure 17:
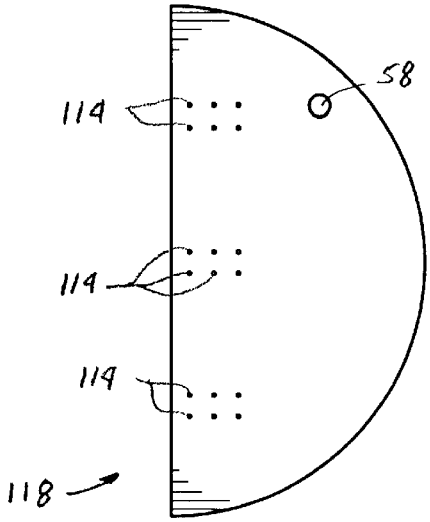
FIG. 17 is a diagrammatic top view of yet another step in a method of making a debris-catcher, according to a preferred embodiment of the present invention.
Figure 18:
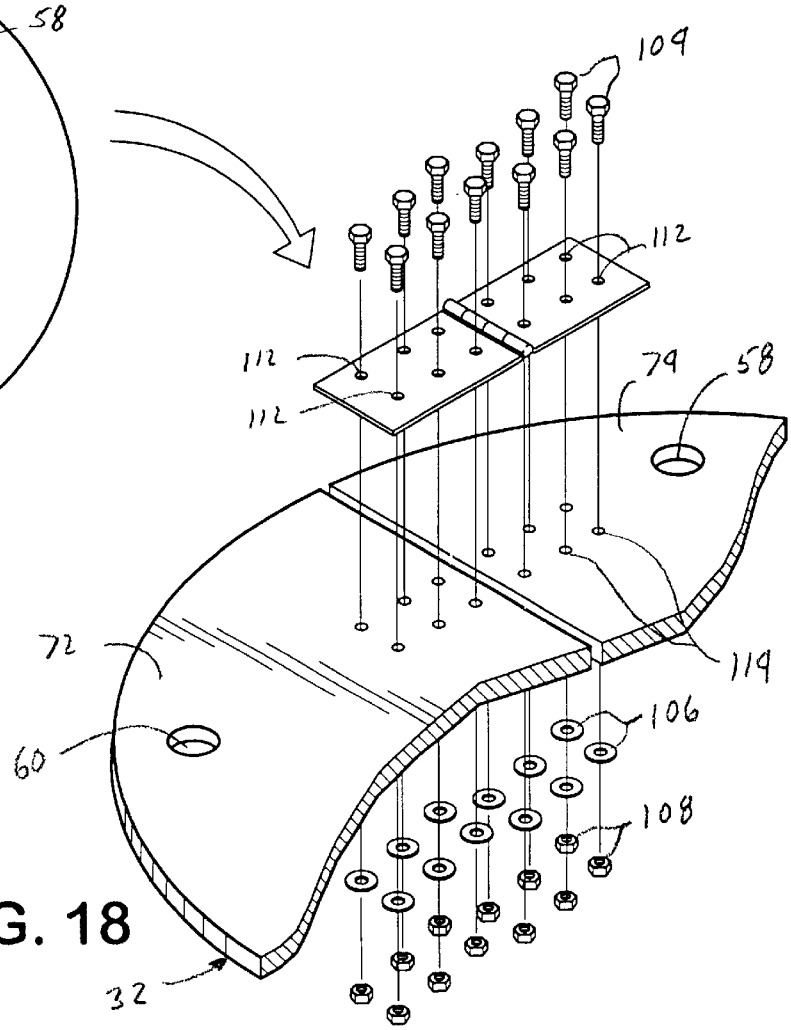
FIG. 18 is a perspective view, partially in section, of a further step in a method of making a debris-catcher, according to a preferred embodiment of the present invention.

FIGS. 15 through 18 illustrate a preferred method of making the debris-catcher 32. FIG. 15 is a diagrammatic top view of the first step in a method of making a debris-catcher 32, according to a preferred embodiment of the present invention. FIG. 16 is a diagrammatic top view of another step in a method of making a debris-catcher 32, according to a preferred embodiment of the present invention. FIG. 17 is a diagrammatic top view of yet another step in a method of making a debris-catcher 32, according to a preferred embodiment of the present invention. FIG. 18 is a perspective view, partially in section, of a further step in a method of making a debris-catcher 32, according to a preferred embodiment of the present invention.

Preferably, the debris-catcher 32 is made from one-half inch thick HDPE sheeting. Such sheeting is typically supplied in forty-eight inch and sixty inch square sheets (this arrangement embodying herein the step of providing a structural material having an area capable of being cut to a diameter of the required end size). Preferably, as stated above, the debris-catcher 32 is round and at least forty-four inches in diameter for a forty-eight inch flat base 62, and at least fifty-six inches in diameter for a sixty inch flat base 62. Preferably, a debris-catcher for a forty-eight inch flat base 62 is cut from a forty-eight inch HDPE sheeting. Preferably, a debris-catcher for a sixty inch flat base 62 is cut from a sixty inch HDPE sheeting.

In the first preferred step of making a debris-catcher 32, the selected HDPE sheeting 116 is cut in halves 120 and 121, as illustrated in FIG. 15 (this arrangement embodying herein the step of cutting such structural material into two equal halves). The sheeting is very heavy, and cutting it in half allows for a more easily workable size. Under appropriate circumstances, other suitable arrangements may suffice. Preferably, a semi-circle 118 having a radius of one-half of the selected final diameter is then cut from the halves 120 and 121, as shown in FIG. 16 (this arrangement embodying herein the step of cutting each such half in a semi-circle shape having a radius half that of such desired end diameter of such debris-catcher so that each such respective half is substantially equal to each other such half). Several methods and tools may be used by those knowledgeable in such art, however, the inventor prefers a Rebel® Roto-zip® tool with a Saber-Cut® Zip® bit cutting bit (available from Roto-zip Tool Company).

Preferably, after the semi-circle 118 is cut, the pre-drilled holes 112 and apertures 58 and 60 are drilled, as illustrated in FIG. 17, using a standard drill press. Preferably, the two apertures 58 and 60 will align with each other when each respective halves 120 and 121 is aligned as when they are in a folded position as described above in FIG. 14 and FIG. 1 (embodying herein wherein each such lifting aperture is structured and arranged to align with each other respective such lifting aperture when each respective such half is aligned). Preferably, the aligned two apertures 58 and 60 are to be used for raising and lowering the debris-catcher 32 (this arrangement embodying herein whereby each respective aligned lifting aperture can be used together to lift such halves when aligned). Preferably, the pre-drilled holes 114 are drilled next, arranged to align with the hinge pre-drilled holes 112 such that the hinges may be installed connecting each respective halves 120 and 121 (this arrangement embodying herein the step of drilling a plurality of hinge-installation apertures in each such half in such manner as to enable insertion of a corrosion-resistant bolt through each respective such hinge-installation aperture). Under appropriate circumstances, other suitable arrangements may suffice. Similar procedures of drilling are generally well-known by those knowledgeable in the art. Preferably, in the final step of making a debris-catcher 32, the hinges 76 are attached using the bolt 104, washer 106, and nut 108 arrangement, and the two halves 120 and 121 are joined such that the debris-catcher may be placed in a substantially folded position 55 or open position 68 (the above arrangement embodying herein the step of attaching at least one hinge to each such half using such corrosion-resistant bolts, at least one washer, and at least one corrosion-resistant nut, along a hinge axis corresponding to a flat edge of each such half so that such halves can be folded together in a folded position for entry through the top and opened to a substantially-flat position to provided a round such debris catcher having such desired diameter of such required end size). Under appropriate circumstances, other suitable arrangements may suffice.

Applicant's preferred method of using a debris-catcher for impeding debris from entering pipe trench portions of a manhole catch basin will now be described. The manhole catch basin as described herein, will normally have a round top, with a first diameter, flat bottom portions extending over a first area having a second diameter larger than the first diameter, and pipe trench portions below the flat bottom portions. Also, as described herein, the preferred debris catcher comprises a substantially round blocker comprising a substantially-rigid structural material, two half-portions, at least one hinge connection having a hinge axis and connecting the two half-portions. As described, the blocker may be placed in a substantially folded position or in an open substantially-flat position; and each such half-portion comprises an aperture, each such aperture being structured and arranged to align with each other such aperture when such blocker is placed in such substantially folded position.

Preferably, to use this described debris-catcher, the following steps are preferred. First, there is selected a debris-catcher having such desired diameter of such required end size structured and arranged to substantially cover the pipe trench portions (see FIG. 2) below the flat bottom portions when opened to a substantially-flat position. Next, the user preferably folds the debris-catcher in a folded position (see FIG. 1) along a hinge axis corresponding to a flat edge of each such half so that such halves can be folded together in a folded position for entry through the round top of the manhole (see FIG. 1). Next, the user preferably attaches a lifting device (see FIG. 1) through each aligned aperture and lifting and lowering the debris-catcher through the top of the manhole and down through the manhole catch basin to the flat bottom portions. Next, the user preferably un-attaches the lifting device from the debris-catcher. Next, the user preferably unfolds the debris-catcher such that the debris-catcher is opened to a substantially-flat position with the hinges facing upward toward the top of the manhole (see FIG. 2). And next, the user preferably aligns the hinge axis such that most of the hinge axis is supported by the flat bottom portions (see FIGS. 2, 7, 8 and 9).

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination:

a) substantially-rigid blocker means, supportable by the flat bottom portions and larger than the round top, for blocking debris from entering the pipe trench portions; and b) fold means for folding said blocker means so as to permit entry of said blocker means, when folded, into the manhole catch basin through the round top.

2. The debris-catching system according to claim 1 wherein said blocker means comprises attachment means for attaching at least one lifting device to said blocker means.

3. The debris-catching system according to claim 2 wherein said attachment means comprises at least one aperture.

4. The debris-catching system according to claim 1 wherein said blocker means is floatable.

5. The debris-catching system according to claim 1 wherein said fold means comprises at least one hinge.

6. The debris-catching system according to claim 5 wherein said blocker means, when not folded and when supported by the flat bottom portions, is capable of substantially covering the pipe trench portions.

7. The debris-catching system according to claim 1 wherein said blocker means, when not folded and when supported by the flat bottom portions, is capable of substantially covering the pipe trench portions.

8. The debris-catching system according to claim 1 wherein said blocker means, when not folded and when supported by the flat bottom portions, is capable of supporting at least about one-hundred pounds.

9. A debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination:

a) substantially-rigid blocker, supportable by the flat bottom portions and larger than the round top, structured and arranged, when not folded and when supported by the flat bottom portions, to block debris from entering the pipe trench portions; and b) at least one hinge structured and arranged to permit folding of said blocker so as to permit entry of said blocker, when folded, through the round top.

10. The debris-catching system according to claim 9 wherein said blocker is substantially round.

11. The debris-catching system according to claim 10 wherein said blocker comprises at least one hinge connection having at least one hinge axis through a center of said blocker.

12. The debris-catching system according to claim 9 wherein said blocker is floatable.

13. The debris-catching system according to claim 11 wherein said at least one hinge connection comprises three corrosion-resistant strap hinges.

14. The debris-catching system according to claim 13 wherein said at least one hinge connection comprises:

a) three stainless steel strap hinges; and b) a plurality of stainless steel bolts, corrosion resistant washers, and stainless steel nuts;

c) wherein said plurality of stainless steel bolts, corrosion resistant washers and stainless steel nuts connects said three stainless steel strap hinges with said blocker.

15. The debris-catching system according to claim 9 wherein said blocker comprises at least one attachment structured and arranged to permit removable attaching of at least one lifting device to said blocker.

16. The debris-catching system according to claim 15 wherein said attachment comprises at least one aperture.

17. The debris-catching system according to claim 9 wherein said blocker, when not folded and when supported by the flat bottom portions, substantially covers the pipe trench portions.

18. The debris-catching system according to claim 9 wherein said blocker is capable of supporting at least one-hundred pounds of debris.

19. The debris-catching system according to claim 9 wherein said blocker is capable of supporting at least one normal-sized worker.

20. A debris-catching system for impeding debris from entering pipe trench portions of a manhole catch basin, having a round top with a first diameter, flat bottom portions extending over a first area having a second diameter larger than the first diameter, and pipe trench portions below the flat bottom portions, comprising, in combination:

a) a substantially round blocker, wherein said blocker comprises, i) a substantially-rigid structural material, ii) two half-portions, iii) at least one hinge connection connecting said two half-portions;

iv) wherein said blocker may be placed in a substantially folded position and in an open substantially-flat position, v) wherein each said half-portion comprises an aperture, each said aperture being structured and arranged to align with each other said aperture when said blocker is placed in said substantially folded position, vi) whereby said apertures may be used as attachments in lifting and lowering said blocker when said blocker is in said substantially folded position;

b) wherein said substantially round blocker, when in said open substantially-flat position, is structured and arranged to be able to substantially cover the pipe trench portions.

21. The debris-catching system according to claim 20 wherein said substantially round blocker has a diameter selected from the group consisting of:

a) diameters of about forty-four inches to about forty-eight inches;

b) diameters of about fifty-four inches to about sixty inches.

22. The debris-catching system according to claim 20 wherein said structural material comprises High Density Polyethylene (HDPE).

23. The debris-catching system according to claim 20 wherein said at least one hinge connection comprises:

a) three corrosion-resistant strap hinges; and b) a plurality of corrosion-resistant bolts, corrosion-resistant washers, and corrosion-resistant nuts;

c) wherein said plurality of corrosion-resistant bolts, corrosion-resistant washers and corrosion-resistant nuts connects said corrosion-resistant strap hinges to said substantially round blocker.

24. A method of making a debris-catcher, for impeding debris from entering pipe trench portions of a manhole catch basin, having a round top with a first diameter, flat bottom portions extending over a first area having a second diameter larger than the first diameter, and pipe trench portions below the flat bottom portions, comprising the steps of:

a) providing a structural material having an area capable of being cut to a diameter of the required end size;

b) cutting such structural material into two equal halves;

c) cutting each such half in a semi-circle shape having a radius half that of such desired end diameter of such debris-catcher so that each such respective half is substantially equal to each other such half;

d) drilling a lifting aperture in each such half wherein:

i) each such lifting aperture is structured and arranged to align with each other respective such lifting aperture when each respective such half is aligned; and ii) whereby each respective aligned lifting aperture can be used together to lift such halves when aligned;

e) drilling a plurality of hinge-installation apertures in each such half in such manner as to enable insertion of a corrosion-resistant bolt through each respective such hinge-installation aperture;

f) attaching at least one hinge to each such half using such corrosion-resistant bolts, at least one washer, and at least one corrosion-resistant nut, along a hinge axis corresponding to a flat edge of each such half so that such halves can be folded together in a folded position for entry through the top and opened to a substantially-flat position to provide a round such debris catcher having such desired diameter of such required end size.

25. The method of making a debris-catcher according to claim 24 wherein said structural material comprises High Density Polyethylene (HDPE).

26. The method of making a debris-catcher according to claim 24 wherein said at least one hinge comprises three corrosion-resistant strap hinges.

27. A method of using a debris-catcher for impeding debris from entering pipe trench portions of a manhole catch basin, having a round top with a first diameter, flat bottom portions extending over a first area having a second diameter larger than the first diameter, and pipe trench portions below the flat bottom portions wherein the debris catcher comprises a substantially round blocker comprising a substantially-rigid structural material, two half-portions, at least one hinge connection having a hinge axis and connecting the two half-portions, and wherein the blocker may be placed in a substantially folded position or in an open substantially-flat position, and wherein each such half-portion comprises an aperture, each such aperture being structured and arranged to align with each other such aperture when such blocker is placed in such substantially folded position, comprising the steps of:

a) selecting a debris-catcher having such desired diameter of such required end size structured and arranged to substantially cover the pipe trench portions below the flat bottom portions when opened to a substantially-flat position;

b) folding the debris-catcher in a folded position along a hinge axis corresponding to a flat edge of each such half so that such halves can be folded together in a folded position for entry through the round top of the manhole;

c) attaching a lifting device through each aligned aperture and lifting and lowering the debris-catcher through the top of the manhole and down through the manhole catch basin to the flat bottom portions;

d) un-attaching the lifting device from the debris-catcher;

e) unfolding the debris-catcher such that the debris-catcher is opened to a substantially-flat position with the hinges facing upward toward the top of the manhole;

f) aligning the hinge axis such that most of the hinge axis is supported by the flat bottom portions.

* * * * *